US005908085A

United States Patent [19]

Lovelady

[11] Patent Number: 5,908,085

[45] Date of Patent: Jun. 1, 1999

[54] LADDER LEVELING ACCESSORY SYSTEM

[76] Inventor: W. David Lovelady, 13827 CR 1113, Tyler, Tex. 75709

[21] Appl. No.: 09/121,333

[22] Filed: Jul. 23, 1998

Related U.S. Application Data

[63] Continuation-in-part of application No. 08/816,572, Mar. 13, 1997, abandoned.

[51] Int. Cl.[6] ..... E06C 1/00

[52] U.S. Cl. ..... 182/204; 182/111

[58] Field of Search ..... 182/107, 108, 182/109, 111, 200, 201, 203, 204; 248/188.2, 188.5, 188.8

[56] References Cited

U.S. PATENT DOCUMENTS

| | | | |
|---|---|---|---|
| 796,915 | 8/1905 | Ketchum | 182/204 |
| 3,948,352 | 4/1976 | Larson et al. | 182/204 |
| 4,606,432 | 8/1986 | Belt | 182/204 |
| 5,107,958 | 4/1992 | Johnson | 182/204 |
| 5,325,936 | 7/1994 | Baker | 182/204 |
| 5,551,529 | 9/1996 | Molitor | 182/204 |
| 5,609,222 | 3/1997 | Horbacewicz et al. | 182/204 X |
| 5,704,451 | 1/1998 | King | 182/204 |
| 5,718,306 | 2/1998 | Baker | 182/204 |

*Primary Examiner*—Daniel P. Stodola
*Assistant Examiner*—Richard M Smith

[57] ABSTRACT

A ladder leveling accessory system for leveling a ladder on sloped, uneven, or rough surfaces includes a pair of leg extensions held to the rails of the ladder by two sets of bands coupled to the rails of the ladder. The leg extensions are secured in place by a spring loaded handle extending through both leg extensions, the upper bands and the rails of the ladder. In a preferred embodiment, each leg extension includes a pivoting foot having a gripping portion for facilitating secure placement of the foot on a surface.

3 Claims, 4 Drawing Sheets

3
6
12A
6A
4
47
42
44
46
45
16A
12
32
32
10
16
30
54
50
6
6
16A
32
32
16
30
54
50
52

LADDER LEVELING ACCESSORY SYSTEM

CROSS REFERENCE TO RELATED APPLICATION

This application is a continuation-in-part of my prior utility patent application Ser. No. 08/816,572, filed Mar. 13, 1997, now abandoned.

BACKGROUND OF THE INVENTION

1. Field of the Invention

The present invention relates to ladder leveling accessories and more particularly pertains to a new ladder leveling accessory system for providing a leg extension for leveling a ladder on sloped, uneven, or rough surfaces.

2. Description of the Prior Art

The use of ladder leveling accessories is known in the prior art. More specifically, ladder leveling accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art optional equipment for ladders include U.S. Pat. No. 3,998,293; U.S. Pat. No. 5,007,503; U.S. Pat. Des. No. 316,608; U.S. Pat. No. 5,325,936; U.S. Pat. No. 5,273,133; U.S. Pat. No. 5,174,412; U.S. Pat. No. 796,915; U.S. Pat. No. 3,948,352; U.S. Pat. No. 4,606,432; U.S. Pat. No. 5,107,958; U.S. Pat. No. 5,325,936; U.S. Pat. No. 5,551,529; U.S. Pat. No. 5,609,222; U.S. Pat. No. 5,704,451; and U.S. Pat. No. 5,718,306.

While these devices fulfill their respective, particular objectives and requirements, the aforementioned patents do not disclose a new ladder leveling accessory system. The inventive device includes a pair of leg extensions held to the rails of a ladder by two sets of bands and secured in place by a spring loaded handle extending through both leg extensions, the upper bands and the rails of the ladder.

In these respects, the ladder leveling accessory system according to the present invention substantially departs from the conventional concepts and designs of the prior art, and in so doing provides an apparatus primarily developed for the purpose of providing a leg extension for leveling a ladder on sloped, uneven, or rough surfaces.

SUMMARY OF THE INVENTION

In view of the foregoing disadvantages inherent in the known types of ladder leveling accessories now present in the prior art, the present invention provides a new ladder leveling accessory system construction wherein the same can be utilized for providing a leg extension for leveling a ladder on sloped, uneven, or rough surfaces.

The general purpose of the present invention, which will be described subsequently in greater detail, is to provide a new ladder leveling accessory system apparatus and method which has many of the advantages of the ladder leveling accessories mentioned heretofore and many novel features that result in a new ladder leveling accessory system which is not anticipated, rendered obvious, suggested, or even implied by any of the prior art ladder leveling accessories, either alone or in any combination thereof.

To attain this, the present invention generally comprises a pair of leg extensions held to the rails of a ladder by two sets of bands and secured in place by a spring loaded handle extending through both leg extensions, the upper bands and the rails of the ladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ladder leveling accessory system apparatus and method which has many of the advantages of the ladder leveling accessories mentioned heretofore and many novel features that result in a new ladder leveling accessory system which is not anticipated, rendered obvious, suggested, or even implied by any of the prior art ladder leveling accessories, either alone or in any combination thereof.

It is another object of the present invention to provide a new ladder leveling accessory system which may be easily and efficiently manufactured and marketed.

It is a further object of the present invention to provide a new ladder leveling accessory system which is of a durable and reliable construction.

An even further object of the present invention is to provide a new ladder leveling accessory system which is susceptible of a low cost of manufacture with regard to both materials and labor, and which accordingly is then susceptible of low prices of sale to the consuming public, thereby making such ladder leveling accessory system economically available to the buying public.

Still yet another object of the present invention is to provide a new ladder leveling accessory system which provides in the apparatuses and methods of the prior art some of the advantages thereof, while simultaneously overcoming some of the disadvantages normally associated therewith.

Still another object of the present invention is to provide a new ladder leveling accessory system for providing a leg extension for leveling a ladder on sloped, uneven, or rough surfaces.

Yet another object of the present invention is to provide a new ladder leveling accessory system which includes a pair of leg extensions held to the rails of a ladder by two sets of bands and secured in place by a spring loaded handle extending through both leg extensions, the upper bands and the rails of the ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
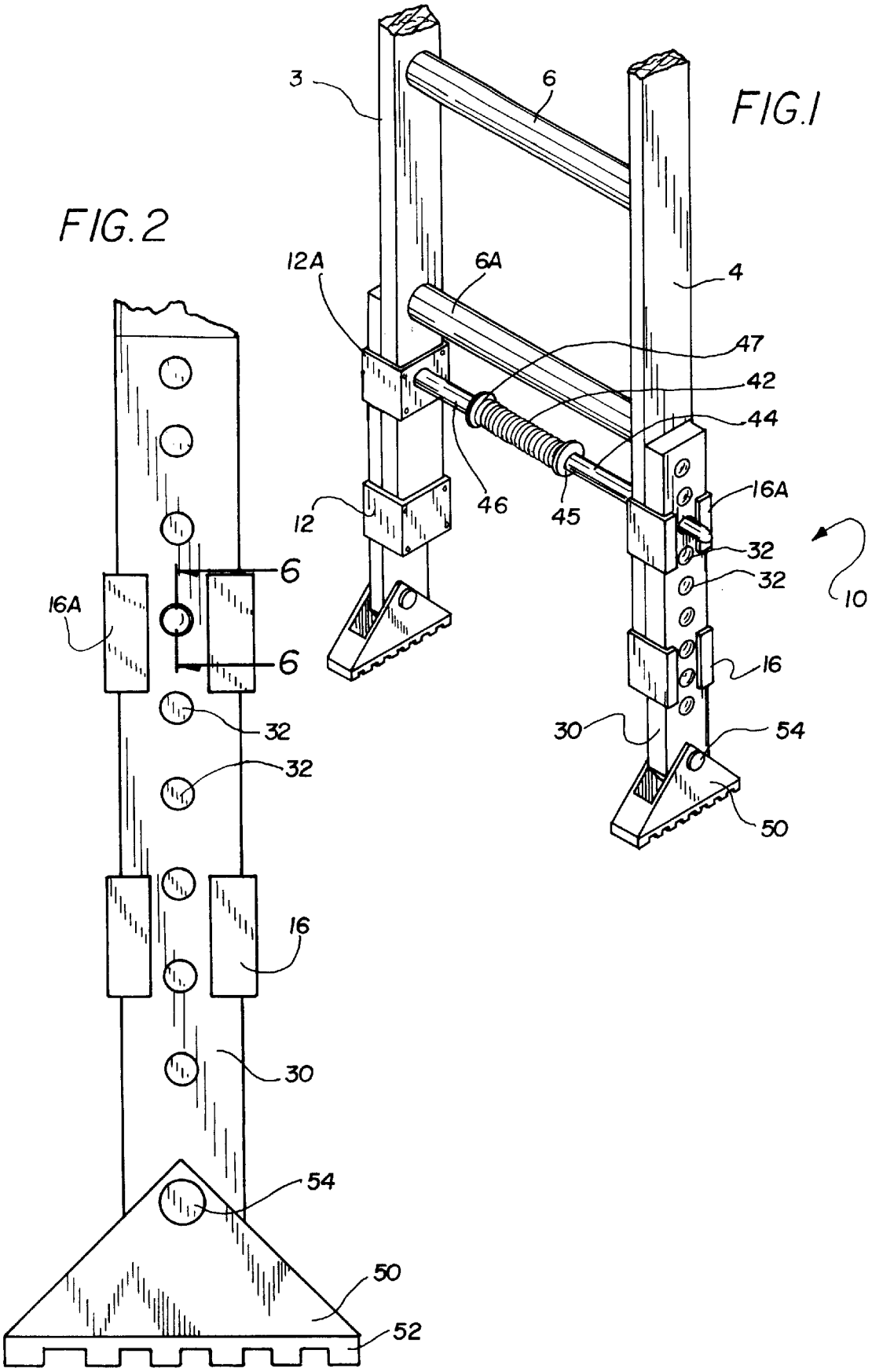
FIG. 1 is a perspective view of a new ladder leveling accessory system according to the present invention.
FIG. 2 is an enlarged side view of a bottom of the ladder.
Figure 3:
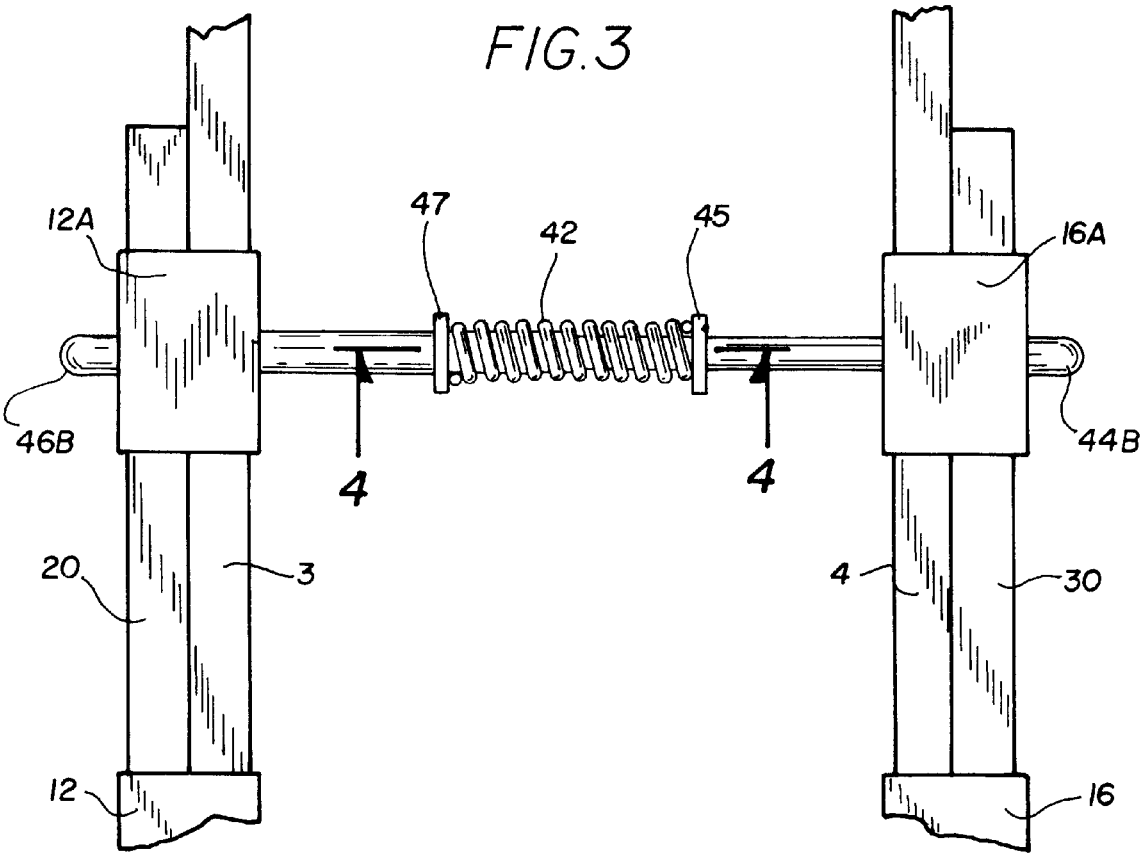
FIG. 3 is an enlarged detailed view of a spring and handle mechanism of the present invention.
Figure 4:
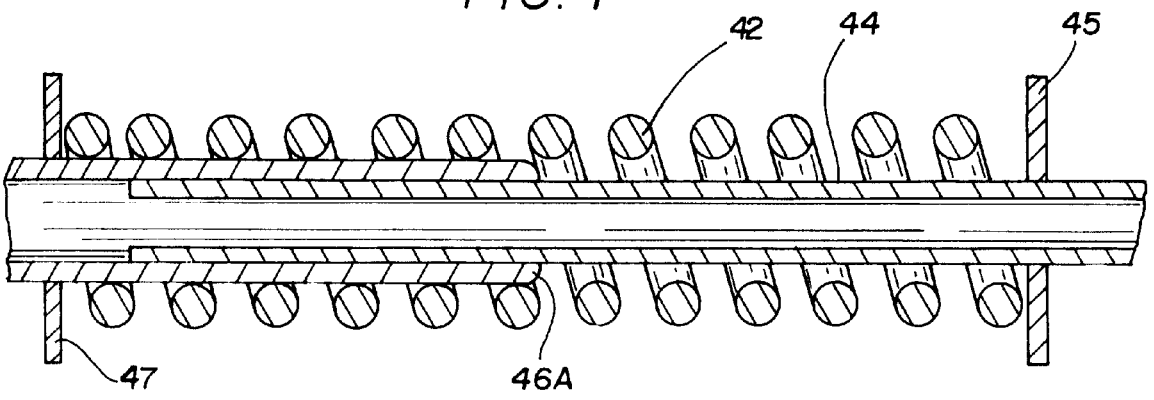
FIG. 4 is a cross-sectional view taken along line 4—4 of FIG. 3.
Figure 5:
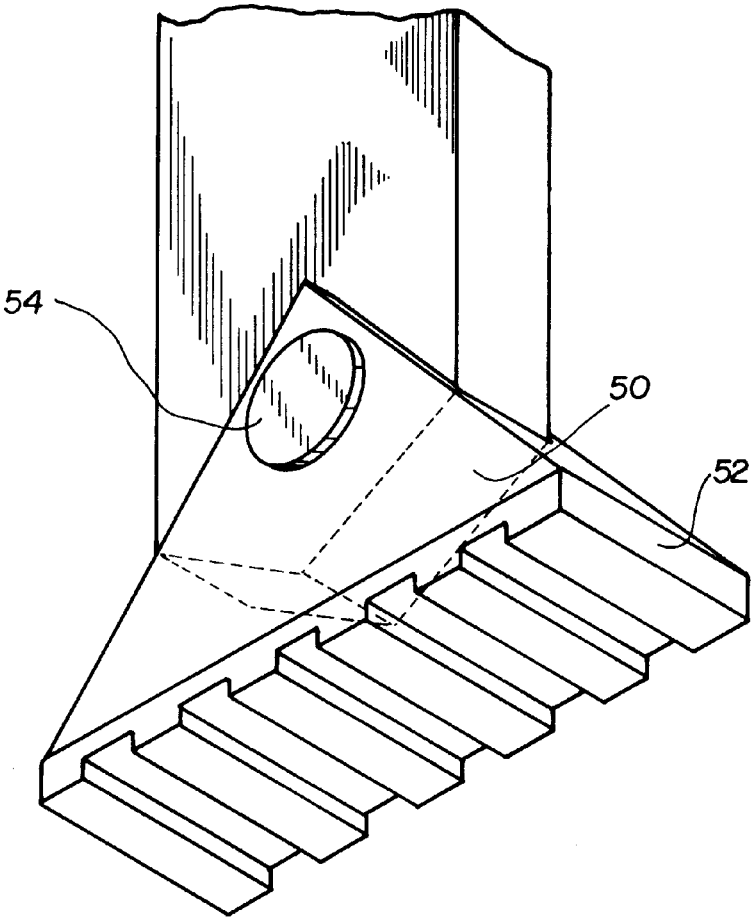
FIG. 5 is an enlarged detailed perspective view of one foot of the present invention.
Figure 6:
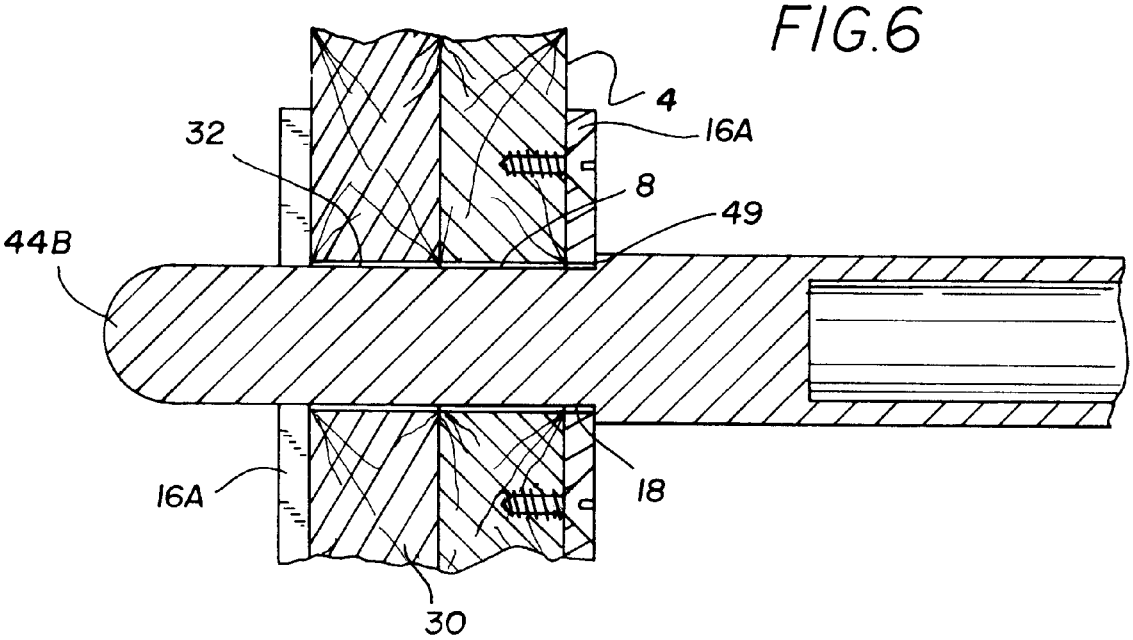
FIG. 6 is an enlarged cross-sectional view taken along line 6—6 of FIG. 2.
Figure 7:
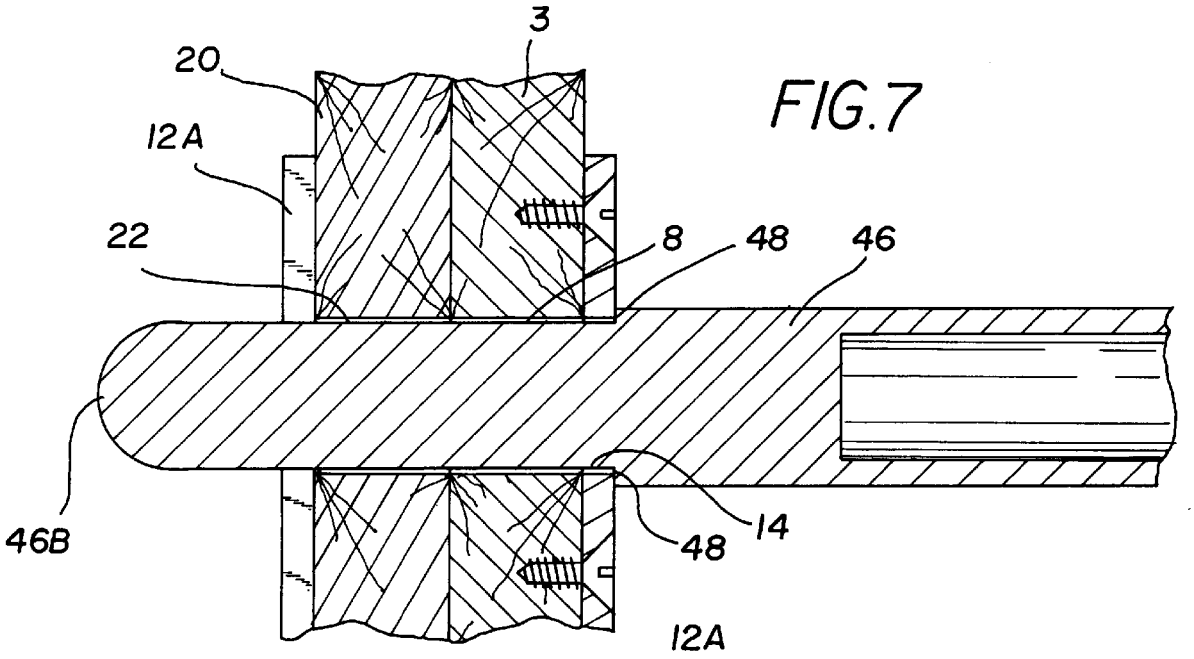
FIG. 7 is an enlarged cross-sectional view taken along line 7—7 of FIG.

With reference now to the drawings, and in particular to FIGS. 1 through 6 thereof, a new ladder leveling accessory system embodying the principles and concepts of the present invention and generally designated by the reference numeral 10 will be described.

As best illustrated in FIGS. 1 through 6, the ladder leveling accessory system 10 comprises a ladder 2 having a first rail 3 and a second rail 4. The ladder 2 also has a plurality of rungs 6, each extending between the first rail 3 and the second rail 4, including a bottom rung 6A also extending between the first rail 3 and the second rail 4. The first rail 3 and the second rail 4 each include a hole 8 therethrough, each hole 8 is positioned between the bottom rung 6A and a lowermost end of each respective rail of the ladder 3A and 4A.

A pair of first rail handle bands 12 and 12A are connected to a the first rail 3 of the ladder 2. Upper handle band 12A includes a hole 14 aligned with the hole 8 in the first rail 3.

A pair of second rail handle bands 16 and 16A are connected to a the second rail 4 of the ladder 2. Upper handle band 16A includes a hole 18 aligned with the hole 8 in the second rail 4.

A first leg extension 20 is insertable through the pair of first rail handle bands 12 and 12A and against the first rail 3 such that the first leg extension 20 is held against the first rail 3. The first leg extension 20 is structured to include a first leg aperture 22 aligned with the first rail hole 8.

A second leg extension 30 includes a plurality of spaced second leg apertures 32. The second leg extension 30 is insertable through the pair of second rail handle bands 16 and 16A against the second rail 4 such that the second leg extension 30 is held against the second rail 4. The second leg apertures 32 are substantially aligned through a central longitudinal axis of the second leg extension 30.

A spring-loaded locking member 40 includes a spring 42, a lock base 44 and a spring handle 46. The lock base 44 and the spring handle 46 are insertable through the spring 42. The lock base 44 is further insertable into a first end of the spring handle 46A.

The lock base 44 includes a lock base spring stop 45 and the spring handle 46 includes a spring handle spring stop 47 such that the lock base spring stop 45 and the spring handle spring stop 47 abut opposing ends of the spring 42 when the lock base 44 and the spring handle 46 are inserted through the spring 42.

The spring handle 46 includes a distal end 46B opposite the spring handle spring stop 47. The spring handle 46 further includes a lip 48 proximate the distal end 46B. The lip 48 is designed for abutting the upper handle band 12A fixed to the first rail 3 of the ladder 2 such that the distal end 46B of the spring handle 46 extends through the upper handle band 12A, the hole 8 in the first rail 3 and the aperture 22 in the first leg extension 20.

The lock base 44 includes a distal end 44B opposite the lock base spring stop 45. The lock base 44 also includes a lip 49 proximate the distal end 44B. Similar to the lip 48, the lip 49 is designed for abutting the upper handle band 16A fixed to the second rail 4 of the ladder 2 such that the distal end 44B of the lock base 44 extends through the upper handle band 16A, the hole 8 in the second rail 4 and a selectable one of the apertures 32 in the second leg extension 30. It is considered to be an obvious variation that the locking member 40 can be turned 180 degrees such that the lock base 44 extends through the first rail 3 and the spring handle 46 extends through the second rail 4.

The lock base 44 and the spring handle 46 each having a respective length between the respective lips, 48 and 49, and the respective spring stops, 45 and 47, such that a distance between the spring stops 45 and 47, when the locking member 40 is positioned between the rails 3 and 4 is less than a length of the spring 42 whereby the spring 42 urges the lock base 44 and the spring handle 46 outwardly such that the locking member 40 is held in place and the leg extensions 20 and 30 are held in place with respect to the ladder 2.

In a most preferred embodiment the first leg extension 20 and the second leg extension 30 each include a pivoting foot 50 connected to a lowermost end of each leg extension 20 and 30 by a connector 54. Each pivoting foot 50 further includes a grooved portion 52 for facilitating secure placement of the foot 50 on a surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder leveling system, comprising:

a ladder having a first and a second rail, a bottom rung extending between said first rail and said second rail, a top rung extending between said first rail and said second rail, and a plurality of intermediate rungs, each of said plurality of intermediate rungs extending between said first rail and said second rail;

wherein said first rail and said second rail each include a hole therethrough, each hole being positioned between said bottom rung and a lowermost end of each respective rail of said ladder;

a pair of first rail handle bands, each first rail handle band being coupled to a said first rail of said ladder, said pair of first rail handle bands having an upper handle band having a hole aligned with the hole in said first rail;

a pair of second rail handle bands, each second rail handle band being coupled to a said second rail of said ladder, said pair of second rail handle bands having an upper handle band having a hole aligned with the hole in said second rail;

a first leg extension, said first leg extension being insertable through said pair of first rail handle bands against said first rail such that said first leg extension is held against said first rail, said first leg extension being structured to include a first leg aperture aligned with said first rail hole;

a second leg extension having a plurality of spaced second leg apertures therethrough, said second leg extension being insertable through said pair of second rail handle bands against said second rail such that said second leg extension is held against said second rail, said plurality of second leg apertures being substantially aligned through a central longitudinal axis of the second leg extension;

a spring-loaded locking member having a spring, a lock base and a spring handle, said lock base and said spring handle being insertable through said spring, said lock base further being insertable into a first end of said spring handle;

said lock base having a lock base spring stop and said spring handle having a spring handle spring stop such that said lock base spring stop and said spring handle spring stop abut opposing ends of said spring when said lock base and said spring handle are inserted through said spring;

said spring handle having a distal end opposite said spring handle spring stop, said spring handle further having a lip proximate said distal end, said lip being for abutting said upper handle band fixed to said first rail of said ladder such that said distal end of said spring handle extends through said upper handle band, said hole in said first rail and said aperture in said first leg extension;

said lock base having a distal end opposite said lock base spring stop, said lock base further having a lip proximate said distal end, said lip being for abutting said upper handle band fixed to said second rail of said ladder such that said distal end of said lock base extends through said upper handle band, said hole in said second rail and a selectable one of said apertures in said second leg extension;

said lock base and said spring handle each having a respective length between said respective lips and said respective spring stops such that a distance between said spring stops when said locking member is positioned between said rails is less than a length of said spring whereby said spring urges said lock base and said spring handle outwardly such that said locking member is held in place and said leg extensions are held in place with respect to said ladder.

2. The ladder leveling system of claim 1, wherein said first leg extension and said second leg extension each include a pivoting foot coupled to a respective lowermost end thereof.

3. The ladder leveling system of claim 2, wherein each pivoting foot includes a gripping portion for facilitating secure placement of said pivoting foot on a surface.

* * * * *